United States Patent [19]
Rudd
[11] 4,292,508
[45] Sep. 29, 1981

[54] TRADING SYSTEM

[76] Inventor: Kenneth N. Rudd, 23, Kings Walk, Shoreham by Sea, Sussex, England

[21] Appl. No.: 48,315

[22] Filed: Jun. 13, 1979

[30] Foreign Application Priority Data

Jun. 14, 1978 [GB] United Kingdom ..... 26959/78

[51] Int. Cl.³ ..... G06M 3/02

[52] U.S. Cl. ..... 235/92 GA; 222/27; 222/92 PE; 222/92 FL; 222/92 ST

[58] Field of Search ..... 235/92 GA, 92 CC, 92 FL, 235/92 ST, 92 PE, 92 DE; 222/27, 23, 39; 194/15

[56] References Cited

U.S. PATENT DOCUMENTS 3,138,385 6/1964 Giacobello ..... 222/27
3,852,576 12/1974 Rudd ..... 235/92 GA
3,916,172 10/1975 Engle ..... 235/92 PE
3,945,531 3/1976 Clairmonte ..... 222/27
4,071,743 1/1978 Upton ..... 235/92 PE
4,100,399 7/1978 Bager ..... 235/92 CC
4,151,404 4/1979 Harrington et al. ..... 235/92 CC

*Primary Examiner*—Joseph M. Thesz
*Attorney, Agent, or Firm*—Pollock, Vande Sande & Priddy

[57] ABSTRACT

Equipment for use in a trading system in which a bonus is given to a customer selected comprises a plurality of stores, such as counters, which are fed successively so that they are filled successively depending on the feeding rate and the capacities of the counters. When a store is filled, feeding is stopped and the bonus appropriate to the filled store is made available to a subsequent customer initiating a transaction. The filled store is emptied and feeding to the stores is resumed until another store is filled and the appropriate bonus is paid. A modification may include a random selector which scans the stores and makes the bonus available if a full store is selected. Means may be provided to display the running bonus and the customer point at which the bonus is payable.

11 Claims, 1 Drawing Figure

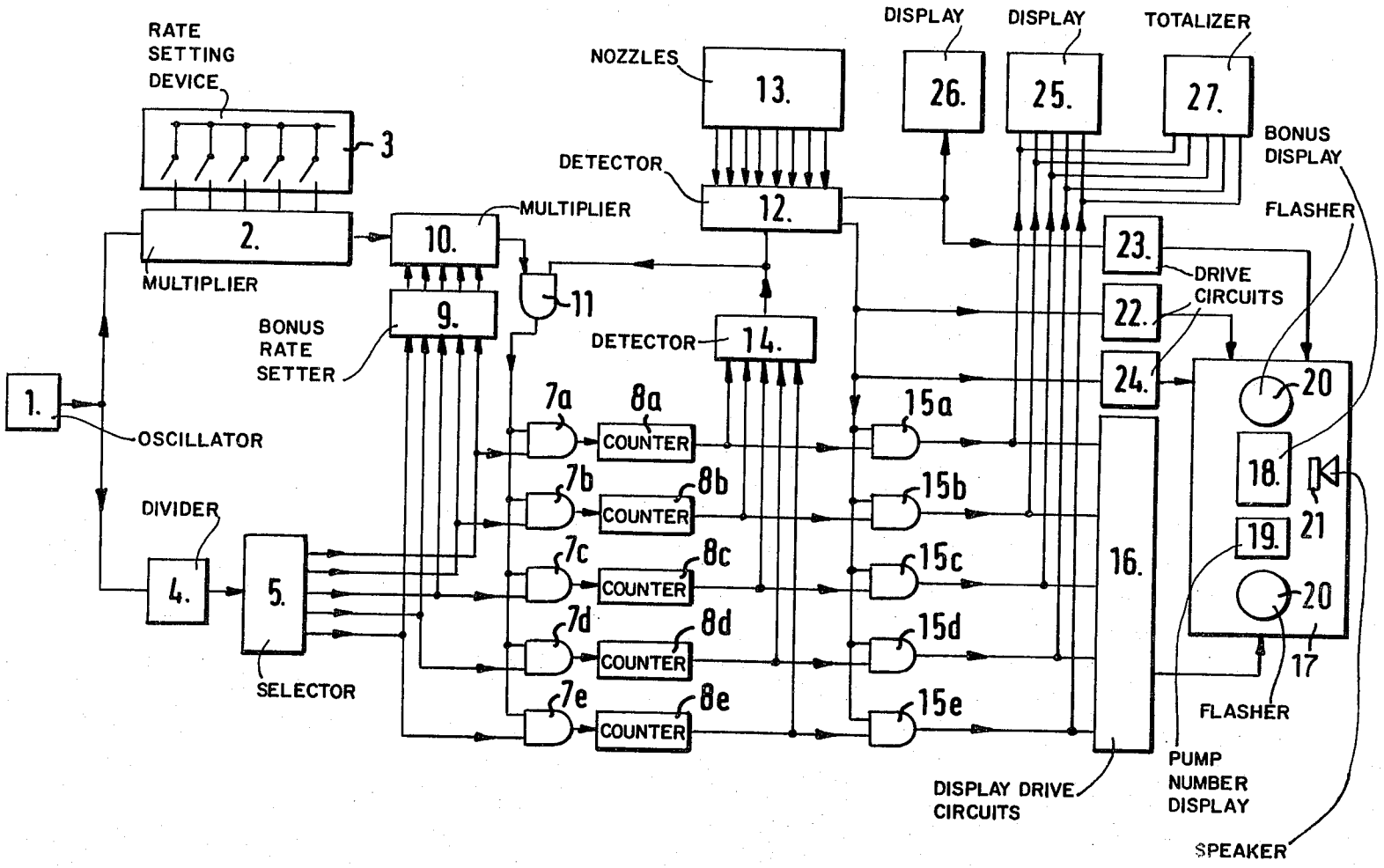
BONUS DISPLAY
FLASHER
TOTALIZER
DRIVE CIRCUITS
FLASHER
PUMP NUMBER DISPLAY
SPEAKER
DISPLAY
DISPLAY
DISPLAY DRIVE CIRCUITS
NOZZLES
DETECTOR
MULTIPLIER
DETECTOR
COUNTER
COUNTER
COUNTER
COUNTER
COUNTER
RATE SETTING DEVICE
MULTIPLIER
BONUS RATE SETTER
OSCILLATOR
DIVIDER
SELECTOR

TRADING SYSTEM

This invention relates to equipment for operating a trading system in which bonus prizes are given to customers of a petrol station or supermarket.

Trading systems are known in which, when the total of a plurality of individual transactions reaches a predetermined magnitude of number or value, a bonus is allocated to a customer making or about to make a further transaction. The transaction may for example be the dispensing of petrol from a petrol pump or the payment for purchases at a market. Equipment for such trading systems is described in British Pat. No. 1,338,083 and U.S. Pat. No. 3,852,576.

The present invention provides equipment for a trading system allocating a bonus to customers, the equipment including means providing signals representing bonus payments and for distributing said signals to a plurality of stores, the signals being provided at a predetermined overall rate as measured over an extended period of time, and means operative to indicate the payment of a bonus when a store is filled to a predetermined amount. The bonus payments may be trading stamps or other valuable consideration and the stores may be counters operated by electronic pulses comprising said signals representing bonus payments from an oscillator which distributes pulses to the counters successively, either at a uniform rate or a rate depending on the magnitude of the bonuses represented by the counters.

An understanding of the basic operation of the equipment will be clear from consideration of the following analogy. A ping pong ball generator produces ping pong balls comprising said signals representing bonus payments at as preferred a constant rate which is set by the mangement. There are five buckets of different sizes that will taken 300, 500, 700, 1000 and 5000 ping pong balls respectively. A single chute from the ping pong ball generator is directed at each bucket in turn for a fixed period of time. Thus all buckets receive balls at the same rate. As soon as any bucket is full, the ping pong generator stops. The other buckets will remain partly filled. The full bucket can then be emptied and the bonus represented by the ping pong balls therein paid out. The sequence is then continued until another bucket becomes full when the bonus applicable to that bucket becomes available. Thus the frequency of a bonus win is inversely proportional to the rate at which the ping pong ball generator is set. If, for example, this rate is set at 4000 balls per hour, each bucket would fill at 800 balls per hour and the 300 bucket would fill every $\frac{3}{8}$ hour, the 500 bucket every $\frac{5}{8}$ hour, the 700 bucket every $\frac{7}{8}$ hour, the 1000 bucket every $1\frac{1}{4}$ hours and the 5000 bucket every $6\frac{1}{4}$ hours.

In the equipment of the present invention, the oscillator is equivalent to the ping pong ball generator and the stores or counters are equivalent to the buckets, assuming a constant rate of pulse generation. As, however, the counters are of equal capacity, the rate of input to each counter is adjusted depending on the magnitude of the bonus represented by that counter.

Said distribution means may operate in a random manner; or alternatively in a predetermined manner so as to provide pseudo-random payments. Said stores may be filled at a set rate and as soon as one is filled, the remaining stores are filled at the set rate until all are filled. Alternatively there may be provided a constant rate per store. When a store is filled, the supply stops, and a reduced proportional total rate is maintained for the remainder. The supply may cease if and when all stores are full.

The automatic allocation of a full store to a bonus payment is not a necessary restriction. Alternatively, a win signal may be provided by suitable means, causing the hunt for a full store or a random selection of any store, whether full or not. Selection of a full store would indicate a prize, whereas the selection of a partly full store would negative the display of a win and the system would be restored awaiting the next win hunt signal. The chance of a win selection thus increases as each store becomes full.

The equipment could be operated in debit instead of credit. Thus a prize is paid after random selection at the first prize hunt, the balance being restored later. When a satisfactory balance has been restored, then another random selection takes place and the time elapse will be proportional to the amount required to be paid back.

When a bonus is ready to be allocated, the signal providing means may as be preferred inhibited or alternatively may continue to operate.

Where the signal providing means is inhibited upon allocation of a bonus, a reset means is provided to enable the signal providing means subsequent to payment of the bonus to a customer by an operator. The delay in resetting may cause a reduction in the rate at which bonus signals are provided; however, such reduction may be controlled to within acceptable limits so that over an extended period of time, the rate of bonus signals is predetermined. An automatic reset may be provided after a predetermined delay.

For convenience the invention will be described in relation to its use in connection with the dispensing of petrol from a petrol pump, but it will be understood that the invention is applicable to various other methods of conducting transactions, such for example as the operation of a till.

Where a number of petrol pumps are associated with the equipment, means may be provided for randomly selecting a particular pump at which the bonus is payable.

Equipment according to the invention may include means for displaying on the petrol station forecourt and at the cashier's console, the number of the winning pump, the magnitude of the bonus and other relevant information. An audible indication may also be given on a bonus being obtained. A totalizer in the console records the size of the bonus, while on the forecourt flashing lights and a win tone indicate that a bonus prize has been won. When the customer has received the bonus, then the operator depresses a reset button and the displays are blanked, also allowing the pulses to be fed to the counters again.

In a modification, a random selector is provided to scan all the counters and choose one irrespective of whether it is full or not. If the counter selected happens to be full, the payout is made; if not, there is no payment although some other counter may be full. The process may continue until at some subsequent transaction the selector selects a full counter. Scanning of the stores may occur in response to the start of petrol flow, or at intervals while petrol flow is taking place.

Other modifications are that a predetermined program of total bonus flow is maintained into the other non-full counters after one or more is full, providing an increasing chance of a win in slack times. Alternatively, the machine can be arranged so that as a counter is full, the input to that counter is stopped and the total payout thus be progressively reduced as each becomes full. When all counters were full in any case, the payout would cease, until the next payout had been taken up.

Another alternative arrangement of operation provides that a single 'large store' is provided into which all the payout flows at a constant rate. The outlet from this store is via the directions of a random selector which for example would provide 'segments' with similar payout provisions.

Sensed and operated in the same way, the payout would not now select automatically the 'full store' but choose any 'store' and if this was full, then make a payout.

The equipment may include a sensing device which having sensed that all stores were full, or that a large store was capable of paying out an immediate sequence of payouts due to lack of use over a period, then a time delay mechanism comes into operation to segregate the payouts over a period.

Provision could also be made to pre-load the 'store' or stores at the start of business by an override providing the appropriate signals or by a storage system to hold information, say overnight, for the commencement of trade on re-opening.

One embodiment of the invention will now be described with reference to the accompanying drawing, the single figure of which is a block diagram of equipment according to the invention.

In this embodiment which will be described as providing bonuses in the form of trading stamps, a main oscillator 1 provides electronic pulses at an output rate determined by a first decimal rate multiplier 2 controlled by a stamp rate setting device 3. The device 3 under the control of the management determines the rate of the overall bonus, for example 8000, 4000, 2000, 1000, or 500 stamps per hour.

The pulses from the oscillator 1 are divided by 256 in a divider 4 and fed to a 1-of-5 selector 5 which supplies the input through gates 7*a*, 7*b*, 7*c*, 7*d*, 7*e* to each of five bonus counters 8*a*, 8*b*, 8*c*, 8*d*, *l* 8*e* in turn. The modified pulse train from the selector 5 is fed through a bonus rate setter 9 to a second decimal rate multiplier 10, where the output rate is again modified depending on the bonus counter which is enabled. This output is fed through a gate 11 to the appropriate gate 7*a*, 7*b*, 7*c*, 7*d*, or 7*e* of the enabled counter 8*a*, 8*b*, 8*c*, 8*d*, or 8*e*. The counters are then fed at a rate inversely proportional to the bonus to be stored therein. For example, the counter 8*a*, for a bonus of 300 stamps will have the highest input rate and the counter 8*e* for 5000 stamps will have the lowest input rate.

When a counter is full, this is detected by a bonus ready detector 14 which feeds a winning nozzle detector 12. The nozzles 13 of say eight pumps are connected electronically to the detector 12 so that when a selected nozzle is lifted, a signal is sent back through the gate 11 to inhibit pulses from the oscillator 1 and initiate the pay out of bonus to the user of the selected pump.

The winning nozzle detector is connected to gates 15*a*, 15*b*, 15*c*, 15*d* and 15*e* which are connected to the bonus counters 8*a*, 8*b*, 8*c*, 8*d* and 8*e* respectively and the outputs from these gates are fed to forecourt display relay drive circuits 16, which in turn operate a forecourt display 17. This display may show on a bonus display 18 the bonus which has been made available and the winning pump on a pump number display 19. Flashing beacons 20 and a speaker 21 are also operated. This display equipment is fed from the winning nozzle detector 12 through drive circuits 22, 23 and 24.

At the console in the cashier's kiosk, there is provided a winning pump number display 25 and a winning bonus display 26. Bonus totalizing circuitry 27 in parallel with the bonus display 25 totalizing the amount of bonus paid out.

When the bonus has been paid to the customer the appropriate counter is emptied. A reset button is operated and the sequence recommences and continues until another counter is filled. The next counter to be filled depends on the capacity of the counters and the extent to which they were filled when payment of the preceding bonus was paid.

The reset button is enabled a predetermined time after display of the bonus win, to prevent misuse of the reset button. In addition, to prevent misuse, means provided to ensure bonus allocations will not be made unless a nozzle has been lifted from the pump for more than a predetermined time, e.g., fifteen seconds.

Display of the win on the forecourt may be delayed for a determined time. k

Modifications to the system may be envisaged. Thus for example, a full store may be allocated to one of a plurality of pumps selected at random. The rate at which bonuses are allocated may be displayed to give customers an idea of the magnitude and chances of a bonus being won.

The equipment according to the present invention may be incorporated in a computer system in which case the stores are provided by the read/write memory of the system. The computer system may comprise a number of terminals interfacing to a host computer system, as is common in computer trading systems.

I claim:

1. Apparatus for use in a trading system to determine the allocation of bonuses to customers, comprising means for continuously generating input signals at a fixed rate proportional to time, a plurality of store means, distribution means coupled to said signal generating means for distributing said input signals to said plurality of store means, and means coupled to said store means for receiving from said store means respective store-full signals, said last-named means being responsive to said store-full signals for conditioning the apparatus in readiness to allocate a bonus which is determined by which store means is full.

2. Apparatus according to claim 1, including means responsive to said store-full signals for inhibiting the generation of said input signals.

3. Apparatus according to claim 1, including means responsive to said store-full signals for inhibiting the distribution of said input signals to said store means.

4. Apparatus according to claim 1, in which said distribution means is operative to distribute said input signals sequentially to each of said store means.

5. Apparatus according to claim 1, in which said distribution means is operative to distribute said input signals in different ratios to each of said store means.

6. Apparatus according to claim 1, wherein said apparatus is responsive to the occurrence of sales transactions, said apparatus including random selector means arranged to be initiated by a next sales transaction to select randomly one of said store means and to inhibit the allocation of said bonus if the selected store means is not full.

7. Apparatus according to claim 1, in which said store means comprise the read/write memory of a computer system.

8. Apparatus for use in a trading system to determine the allocation of bonuses to customers, comprising means for continuously generating input signals at a fixed rate proportional to time, distribution means for receiving said input signals and distributing said input signals to a plurality of store means, means for receiving from said store means respective store-full signals to condition said apparatus in readiness to allocate a bonus which is determined by which store means is full, and means responsive to the occurrence of a next sales transaction to allocate said bonus.

9. Apparatus according to claim 8, including means responsive to the commencement of a next sales transaction for allocating said bonus if the transaction persists for longer than a predetermined time period.

10. Apparatus according to claim 9, including random selector means responsive to the allocation of said bonus to select randomly one of said store means and to inhibit said allocation if the selected store means is not full.

11. Apparatus according to claim 8, including random selector means responsive to the allocation of said bonus to select randomly one of said store means and to inhibit said allocation if the selected store means is not full.

* * * * *